United States Patent [19]

Grimm

[11] Patent Number: 4,890,092

[45] Date of Patent: Dec. 26, 1989

[54] DOOR STOP ALARM

[76] Inventor: Virgil A. Grimm, 2760 34th St., Allegan, Mich. 49010

[21] Appl. No.: 255,942

[22] Filed: Oct. 11, 1988

[51] Int. Cl.[4] ..... G08B 13/08

[52] U.S. Cl. ..... 340/546; 200/61.93; 292/339

[58] Field of Search ..... 340/546; 200/61.93, 200/61.62; 116/13; 292/339, 338

[56] References Cited

U.S. PATENT DOCUMENTS

| | | | |
|---|---|---|---|
| 828,834 | 8/1906 | Bell | 340/546 |
| 1,944,783 | 1/1934 | Ciriacy et al. | 292/338 |
| 3,432,843 | 3/1969 | Spring | 340/546 |
| 3,932,856 | 1/1976 | Tremont | 340/546 |
| 4,264,899 | 4/1981 | Menzies | 340/546 |
| 4,442,427 | 4/1984 | Morton | 340/546 |
| 4,483,558 | 11/1984 | Van Meter | 292/339 |
| 4,607,253 | 8/1986 | Wooten | 340/546 |

*Primary Examiner*—Glen R. Swann, III
*Attorney, Agent, or Firm*—Leon Gilden

[57] ABSTRACT

A wedge-shaped housing mounts a reciprocating elongate switch medially positioned and resiliently biased through an upper face of the wedge. Upon depression of the wedge by a door opening, a circuit is completed to actuate an included alarm. A variety of friction surfaces can be removably secured to an underlying surface of the housing.

10 Claims, 1 Drawing Sheet

DOOR STOP ALARM

BACKGROUND OF THE INVENTION

1. Field of the Invention

The field of the invention relates to alarms, and more particularly pertains to a new and improved door stop alarm which may be portably transported during periods of non-use and may be easily and efficiently positioned adjacent a door to limit opening of the door and effect an alarm upon such attempted opening.

2. Description of the Prior Art

The use of alarms in association with doors to indicate an attempted opening thereof is well known in the prior art. As may be appreciated, alarms of the past have included awkward organizations or organizations limiting the effective positioning of associated alarms and their sounding capabilities as opposed to the instant invention. For example, U.S. Pat. No. 828,834 to Bell sets forth an adjustable alarm wherein a top planar member is slidably mounted on a lower planar member to engage a switch mounted to the lower member to complete a circuit and actuate an alarm. The Bell patent relies on a particular angular positioning of the apparatus, as opposed to the instant invention which may be readily presented before a door to secure same and provide an alarm therefore.

U.S. Pat. No. 3,432,843 to Spring sets forth a signal device positionable before a door in the shape of a sphere wherein opening of the door repositions the sphere and enables an alarm to be actuated.

U.S. Pat. No. 3,932,856 to Tremont sets forth a rectangular housing including an alarm therein whereupon opening of a door engages an arm extending outwardly of the housing to actuate an alarm associated with the housing.

U.S. Pat. No. 4,264,899 to Menzies sets forth a portable alarm that will emit a signal when tilted from a pre-set orientation relative to a door. The Menzies patent provides no latching of the door, as set forth by the instant invention.

U.S. Pat. No. 4,442,427 to Morton sets forth a door lock wherein an extensible tubular member is positionable about a door knob and a floor adjacent the door knob to secure the door and provide an alarm upon undesirable opening of the door.

U.S. Pat. No. 4,607,253 to Worten sets forth a device similar to that of the Morton patent wherein an extensible shaft includes a plurality of pads at distal ends thereof for securement to a door and to an associated floor surface including an alarm to be actuated upon attempted opening of the door.

As such, it may be appreciated that there continues to exist a need for a new and improved door stop alarm that effectively incorporates the features of safety as well as indication of undesirable door opening and in this respect, the present invention substantially fulfills this need.

SUMMARY OF THE INVENTION

In view of the foregoing disadvantages inherent in the known types of portable door alarms now present in the prior art, the present invention provides a door stop alarm wherein the same may be readily and effectively positioned before a door to maintaining a door in a closed position and further providing an associated alarm for indication of attempted undesirable opening of the door. As such, the general purpose of the present invention, which will be described subsequently in greater detail, is to provide a new and improved door stop alarm which has all the advantages of the prior art door alarms and none of the disadvantages.

To attain this, the present invention includes a wedge-shaped housing including a reciprocating switch bar positioned in a reciprocating manner through an upper face of the wedge for completing of a circuit within the wedge including a battery source and audible alarm to indicate depression of the switch by a door. The wedge-shaped housing further provides a degree of safety by maintaining the door in a closed orientation wherein one of a plurality of removable friction faces is available including nails, fabric hook members, and a tread-like pattern upon a resilient face for engaging various surfaces that may be available adjacent a door.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor it it intended to be limiting as to the scope of the invention in any way.

It is therefore an object of the present invention to provide a new and improved door stop alarm which has all the advantages of the prior art door alarms and none of the disadvantages.

It is another object of the present invention to provide a new and improved door stop alarm which may be easily and efficiently manufactured and marketed.

It is a further object of the present invention to provide a new and improved door stop alarm which is of a durable and reliable construction.

An even further object of the present invention is to provide a new and improved door stop alarm which is susceptible of a low cost of manufacture with regard to both materials and labor, and which accordingly is then susceptible of low prices of sale to the consuming public, thereby making such door stop alarms economically available to the buying public.

Still yet another object of the present invention is to provide a new and improved door stop alarm which provides in the apparatuses and methods of the prior art some of the advantages thereof, while simultaneously overcoming some of the disadvantages normally associated therewith.

Still another object of the present invention is to provide a new and improved door stop alarm wherein the same provides a wedging action to maintain a door in closed position and may further provide an audible alarm to indicate undesirable opening of the door.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 5:
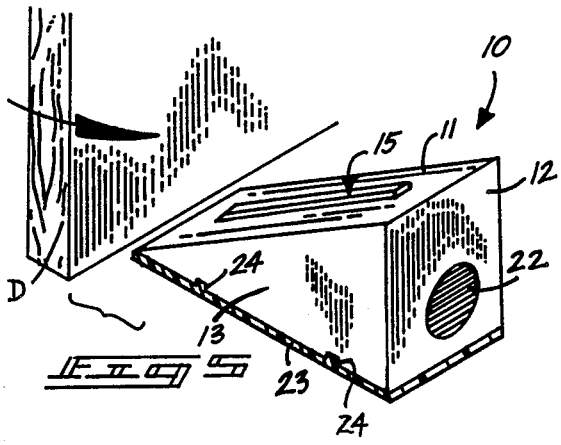
FIG. 5 is an isometric illustration of the instant invention.

With reference now to the drawings, and in particular to FIGS. 1 to 6 thereof, a new and improved door stop alarm embodying the principles and concepts of the present invention and generally designated by the reference numeral 10 will be described.

More specifically, the present invention comprises a door stop alarm formed with a wedge-shaped housing of a triangular cross-sectional configuration including a top wall 11 serving as the hypotenuse with an integrally secured rear wall 12 downwardly directed to an orthogonally securable friction insert 23 securable to a floor of the alarm apparatus 10 and to the side walls 13.

The top wall 11 includes a "T" shaped recess projecting inwardly below the surface of the top wall 11 and reciprocatingly supporting an elongate "T" shaped switch member 15 including a central upwardly oriented leg 17 normally positioned upwardly beyond the top wall 11 including a downwardly tapered forward surface 16 upon which an opening door "D" may be slidably received. The central leg 17 is integrally secured to a head 18 positionable within a complementary portion of the "T" shaped recess 14. An elongate spring 19 normally biases the "T" shaped switch 15 above the surface of top wall 11, as illustrated.

Upon depression of the "T" shaped switch 15 interiorly of the housing of the door stop alarm 10, a plunger switch 20 is depressed and completes a circuit energized by included battery 21 to actuate an audible alarm 22 positioned through the rear wall 12.

A removable friction insert 23 is normally attached to the lowermost portion of the housing of the alarm 10 and includes a series of traction projections 25 to enhance frictional engagement with a support surface, the insert 23 being secured to the housing by a plurality of dovetail projections slidingly interfitting within complementary recesses formed within the housing.

Figure 6A:
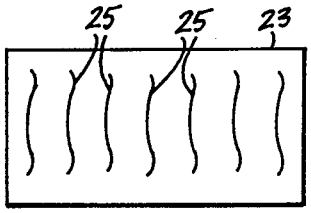
FIGS. 6*a*, 6*b*, and 6*c* are bottom plan views of various friction inserts utilized by the instant invention.
Figure 6B:
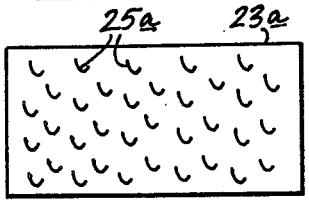
Figure 6C:
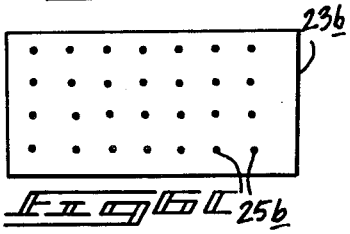
Figure 1:
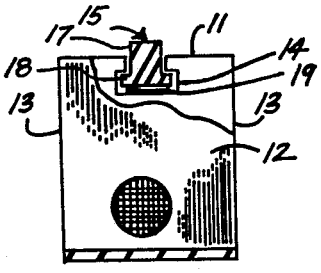
FIG. 1 is a rear orthographic view of the instant invention.
Figure 2:
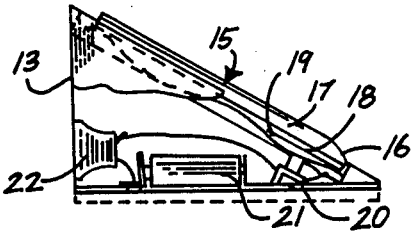
FIG. 2 is a side orthographic view partially in section to illustrate the internal components of the invention.
Figure 3:
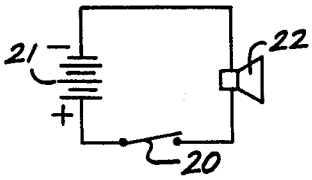
FIG. 3 is a diagrammatic representation of the circuit associated with the instant invention.
Figure 4:
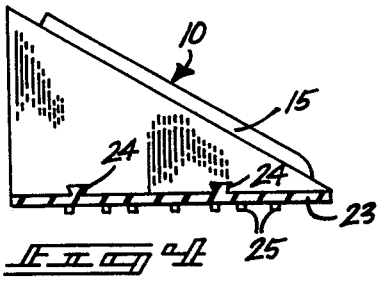
FIG. 4 is a side orthographic view of the instant invention.

Attention to FIG. 6 illustrates various inserts attachable to the housing for cooperation with the various surfaces, whereas the insert 23 may be normally used with a wooden surface, whereas the hook-shaped fabric fasteners 25*a* secured onto the insert 23*a* may be utilized with carpeted surfaces and the nails 25*b* projecting orthogonally outwardly of the insert 23*b* surface may be used with composition floor surfaces, such as cork and the like.

In use, the apparatus 10 is merely positioned in contact with a door "D" to wedge the door in place, but should forcible and undesirable entry be forthcoming, depression of the "T" shaped switch 15 will actuate the audible alarm 22.

The manner of usage and operation therefore of the instant invention should be apparent from the above description and accordingly no further discussion relative to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by letters patent of the United States is as follows:

1. A portable door-securing and alarm apparatus for positioning in contiguous relationship with a door comprising, a wedge-shaped housing including a top wall, a rear wall, a plurality of side walls joining said rear and top wall and a bottom friction insert releasably secured to said side walls, and a reciprocating switch positioned interiorly of said housing and extending outwardly of said top wall and in electrical communication with an internal switch to activate an alarm upon movement of said door over said top wall.

2. A portable door-securing and alarm apparatus as set forth in claim 1 wherein said reciprocating switch is of a "T" shaped configuration reciprocatably positionable within a complementary recess formed in said housing including a slot in said top wall wherein said reciprocating switch is normally biased to extend outwardly of said top wall.

3. A portable door-securing and alarm apparatus as set forth in claim 2 wherein said reciprocating switch includes a tapered forward portion to slidingly accept the door thereover.

4. A portable door-securing and alarm apparatus as set forth in claim 3 wherein said reciprocating switch is normally biased outwardly of said top wall by an elongate spring underlying said reciprocating switch.

5. A portable door-securing and alarm apparatus as set forth in claim 4 wherein a battery is positioned within said housing to activate said alarm.

6. A portable door-securing and alarm apparatus as set forth in claim 5 wherein said alarm comprises an audible alarm mounted onto said rear wall.

7. A portable door-securing and alarm apparatus as set forth in claim 6 wherein said bottom friction insert is slidably mounted to said housing by a plurality of dovetail projections integrally formed to said insert and received within complementary recesses formed in said housing.

8. A portable door-securing and alarm apparatus as set forth in claim 7 wherein said insert is resilient and includes a series of spaced traction projections.

9. A portable door-securing and alarm apparatus as set forth in claim 8 wherein said friction insert includes a plurality of fabric hook fasteners.

10. A portable door-securing and alarm apparatus as set forth in claim 7 wherein said insert includes a plurality of nails for frictionally engaging a support surface.

* * * * *